US010247158B2

(12) United States Patent
Saito et al.

(10) Patent No.: US 10,247,158 B2
(45) Date of Patent: Apr. 2, 2019

(54) FUEL INJECTION VALVE

(71) Applicant: HITACHI AUTOMOTIVE SYSTEMS, LTD., Hitachinaka-shi, Ibaraki (JP)

(72) Inventors: Takahiro Saito, Isesaki (JP); Nobuaki Kobayashi, Maebashi (JP); Eiji Tamura, Isesaki (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 15/551,459

(22) PCT Filed: Feb. 5, 2016

(86) PCT No.: PCT/JP2016/053505
§ 371 (c)(1),
(2) Date: Aug. 16, 2017

(87) PCT Pub. No.: WO2016/147738
PCT Pub. Date: Sep. 22, 2016

(65) Prior Publication Data

US 2018/0045156 A1 Feb. 15, 2018

(30) Foreign Application Priority Data

Mar. 13, 2015 (JP) ..... 2015-050291

(51) Int. Cl.
*F02M 61/18* (2006.01)
*F02M 51/06* (2006.01)

(52) U.S. Cl.
CPC ..... *F02M 61/1806* (2013.01); *F02M 51/06* (2013.01); *F02M 51/061* (2013.01); *F02M 51/0682* (2013.01); *F02M 61/1853* (2013.01)

(58) Field of Classification Search
CPC ..... F02M 61/1806; F02M 51/061
(Continued)

(56) References Cited

U.S. PATENT DOCUMENTS 3,567,135 A * 3/1971 Gebert ..... F02M 51/0667 239/463
4,342,427 A * 8/1982 Gray ..... F02M 51/0685 239/585.2

(Continued)

FOREIGN PATENT DOCUMENTS

JP 2006-037846 A 2/2006
JP 2008-509333 A 3/2008

(Continued)

*Primary Examiner* — Chee-Chong Lee
(74) *Attorney, Agent, or Firm* — Foley & Lardner LLP

(57) ABSTRACT

A fuel injection valve includes a valve seat 15*b* and a valve body 27*c* that cooperate with each other to open and close a fuel passage, a movable element 27 that has the valve body 27*c* provided at one end thereof and has a fuel passage formed therein, a valve seat member 15 having the valve seat 15*b* formed thereon, an upstream-side communication hole 27*boa* that is located upstream of the flow of fuel and connects the inside and outside of the movable element 27, and a downstream-side communication hole 27*bob* that is located downstream of the flow of fuel and connects the inside and outside of the movable element, in which a guide section for the valve body 27*c*, where the valve seat member 15 and the valve body 27*c* are in sliding contact with each other, is provided downstream of the downstream-side communication hole 27*bob* and in which a fuel passage 17*h* for connecting in the center axis direction the upstream side and downstream side of the guide section is provided at the same angular position in the circumferential direction of the movable element 27 as the downstream-side communication hole 27*bob*. With this arrangement, even if a foreign thing is accidently mixed into the fuel passage during the production process, the foreign thing can be removed with a shorter running-in operation time.

8 Claims, 7 Drawing Sheets

(58) Field of Classification Search
USPC ..... 239/585.1
See application file for complete search history.

(56) References Cited

U.S. PATENT DOCUMENTS

| | | | | | |
|---|---|---|---|---|---|
| 4,494,701 | A * | 1/1985 | Hensley | F02M 51/0667 | 239/585.4 |
| 4,520,962 | A * | 6/1985 | Momono | F02M 51/0675 | 239/488 |
| 4,552,312 | A * | 11/1985 | Ohno | F02M 51/0667 | 239/585.4 |
| 4,597,558 | A * | 7/1986 | Hafner | F02M 51/066 | 239/585.1 |
| 4,662,567 | A * | 5/1987 | Knapp | F02M 51/0671 | 239/585.4 |
| 4,771,984 | A * | 9/1988 | Szablewski | F02M 51/0675 | 239/533.11 |
| 2006/0076438 | A1 | 4/2006 | Dallmeyer | | |

FOREIGN PATENT DOCUMENTS

| | | | |
|---|---|---|---|
| JP | 2009-174423 | A | 8/2009 |
| JP | 2011-144731 | A | 7/2011 |

* cited by examiner

FUEL INJECTION VALVE

TECHNICAL FIELD

The present invention relates to a fuel injection valve that injects fuel.

BACKGROUND ART

As a background technique of this technical field, the fuel injection valve described in Japanese Laid-open Patent Application 2011-144731 (Patent Document-1) is known. The known fuel injection valve of the publication is equipped with a needle valve that is connected to a movable core (movable iron core) by press fitting and welding (paragraph 0047). For communicating an internal space of the movable iron core with an internal space of the needle valve, a connected part between the movable iron core and the needled valve is formed with an inlet opening (paragraph 0044). In a shaft portion of the needle valve, there are formed both a communication hole and another communication hole that are respectively arranged in upstream and downstream sides with respect to a flow direction of fuel. The upstream-side communication hole comprises a plurality of circular openings that are formed near an end (upstream side end portion) of the shaft portion that is connected to the movable iron core. The downstream-side communication hole comprises a plurality of oval openings that are formed near an end (upstream side end portion) of the shaft portion that is sealed. The upstream-side communication hole and the downstream-side communication hole are so constructed that the interior of the shaft portion is communicated with an interior space that is formed in a nozzle holder and a nozzle body through which the needled valve is received (paragraph 0044). With this construction, fuel led into the fuel injection valve from a fuel inlet portion (fuel supply opening) is led into an inner circumference side of the movable iron core, the inlet opening and then into an inner circumference side of the shaft portion of the needle valve. The fuel led into the shaft portion is led into the space formed between the needle valve and a unit of the nozzle holder and nozzle body after passing through the upstream-side communication hole and the downstream-side communication hole (paragraph 0056).

In the fuel injection valve disclosed in Patent Document-1, the shaft portion is constructed of a cylindrical member and fuel in the shaft portion is led into the outside through the communication holes. In this case, however, the interior of the shaft portion tends to generate a dead fuel flow region (stagnation) and a part where the fuel flow speed is lowered.

In fuel injection valves, for dealing with a case in which a foreign thing is accidently mixed into a fuel flow passage of the fuel injection valve during the production process, the fuel injection valves produced are subjected to a running-in operation for discharging the foreign thing to the outside. Thus, if the above-mentioned dead fuel flow region (stagnation) and the lowered fuel speed region are present, discharging the foreign thing to the outside takes time and thus the running-in operation of the valves has to be carried out for a long time. Production efficiency is lowered as the running-in operation takes a longer time. Furthermore, energy and cleaning liquid consumed by the running-in operation are increased.

PRIOR ART DOCUMENT

Patent Document

Patent Document-1: Japanese Laid-open Patent Application (tokkai) 2011-144731

SUMMARY OF INVENTION

An object of the present invention is to provide a fuel injection valve that is able to discharge a foreign thing to the outside with a shorter running-in operation time even if the foreign thing has been mixed into the fuel flow passage of the fuel injection valve at the production process.

In order to achieve the above-mentioned object, the present invention provides a fuel injection valve which comprises a valve seat and a valve body, which cooperate with each other to open and close a fuel passage, a movable element having the valve body provided at one end thereof and having a fuel passage formed therein, a valve seat member having the valve seat formed thereon, an upstream-side communication hole located upstream of the flow of fuel and connecting the inside and outside of the movable element and a downstream-side communication hole located downstream of the flow of fuel and connecting the inside and outside of the movable element, wherein a guide section of the valve body, where the valve seat member and the valve body are in sliding contact with each other, is provided downstream of the downstream-side communication hole and wherein a fuel passage for connecting the upstream side and downstream side of the guide section in the center axis direction is provided at the same angular position in the circumferential direction of the movable element as the downstream-side communication hole.

In order to achieve the above-mentioned object, the present invention provides a fuel injection valve which includes a valve seat and a valve body that cooperate with each other to open and close a fuel passage and an electromagnetic drive section that drives the valve body, in which the electromagnetic drive section includes a fixed iron core and a movable iron core that is fixed to the valve body to drive the valve body in the open/close direction with the aid of magnetic attraction force generated between the fixed iron core and the movable iron core, and in which the valve body and the movable iron core are connected through a rod portion that has a fuel passage formed therein, and in which the rod portion is provided with an upstream-side communication hole that is located upstream of the flow of fuel and connects the inside and outside of the rod portion, and a downstream-side communication hole that is located downstream of the flow of fuel and connects the inside and outside of the rod portion; and an area ratio ((S1+S2)/S3) wherein S1 is a sectional area of the upstream-side communication hole, S2 is a sectional area of the downstream-side communication hole and S3 is a sectional area of a fuel passage provided in an inlet part of a fuel passage formed in the rod portion is smaller than 3.5.

According the present invention, due to provision of the communication holes formed in the movable element, the flow speed of fuel that flows from the inside of the movable element to the outside of the same can be increased. Thus, even if a foreign thing is mixed into the fuel passage, the foreign thing can be speedily discharged from the fuel passage and thus, the running-in operation time of the vehicle can be shortened.

Other effects of the present invention will be described in the explanation of embodiments.

EMBODIMENT OF INVENTION

Figure 1:
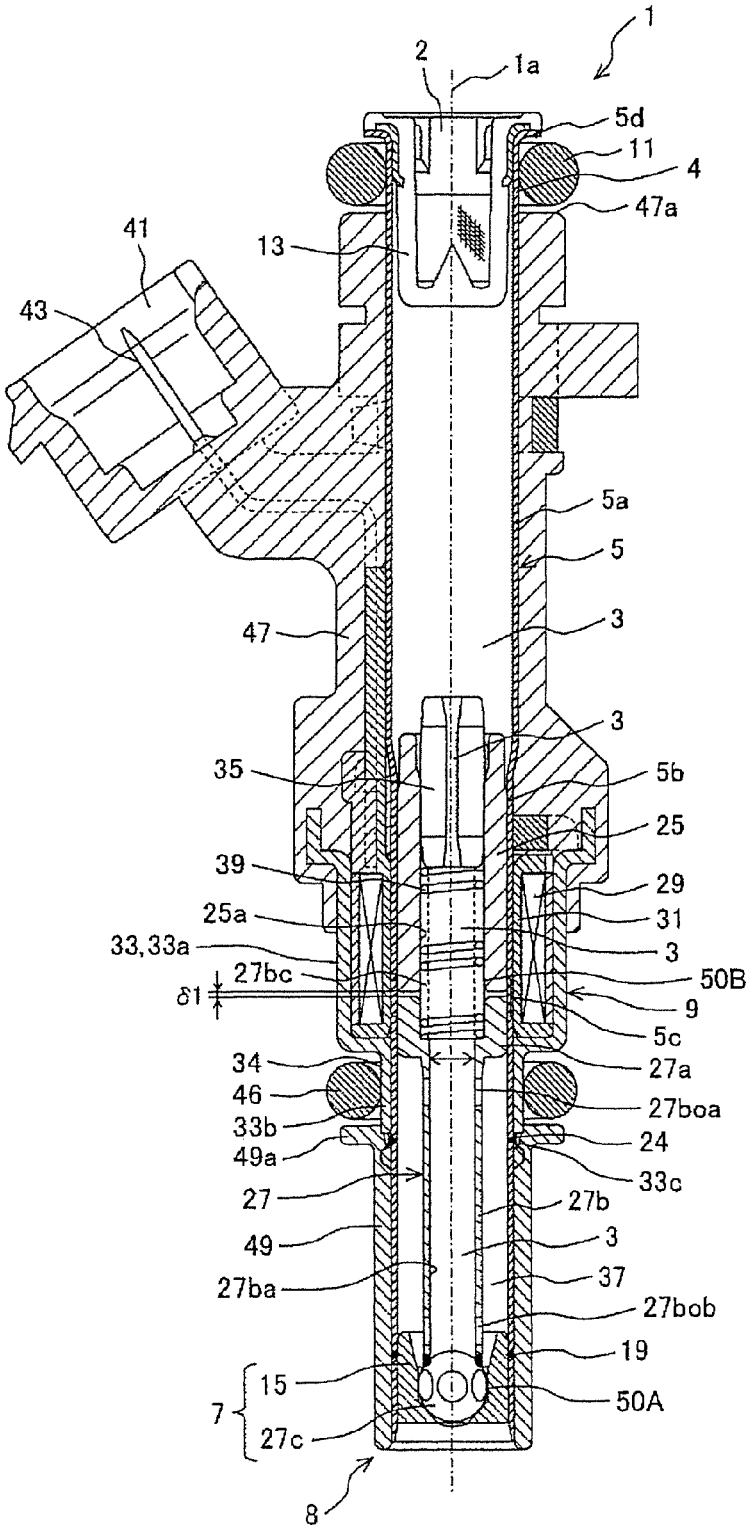
FIG. 1 is a vertically sectional view of an embodiment of a fuel injection valve of the present invention, which is provided by vertically sectioning the valve along a valve shaft axis (center axis line).

In the following, an embodiment of the present invention will be described with reference to FIGS. 1 to 3.

An entire construction of a fuel injection valve 1 will be described with reference to FIG. 1. FIG. 1 is a vertically sectional view of an embodiment of the fuel injection valve of the present invention, which is provided by vertically sectioning the valve along a valve shaft axis (center axis line). It is to be noted that the center axis line 1*a* is matched with an axis (valve axis) of a movable element 27 that has a valve body 27*c*, a rod portion (connecting portion) 27*b* and a movable iron core 27*a* integrally provided thereto, and the center axis line is matched with the central axis line of a cylindrical body 5.

In the following, an upper end portion (upper end side) of the fuel injection valve 1 shown in FIG. 1 will be sometimes called as a base end portion (base end side), and a lower end portion (lower end side) of the valve 1 will be sometimes called as a top end portion (top end side). Naming of the base end portion (base end side) and the top end portion (top end side) is based on a direction in which fuel flows or a mounting structure of the fuel injection valve 1 relative to a fuel piping. Upper and lower relation terms used in the specification are based on FIG. 1, and thus, such upper and lower relation terms have no connection with upper and lower relation terms that are used in an actual structure in which the fuel injection valve 1 is mounted in the internal combustion engine.

In the fuel injection valve 1, there is provided, by a cylindrical body 5 of metal, a fuel passage (fuel flow passage) 3 that extends generally along a center axis line 1*a*. The cylindrical body 5 is made of a metallic material such as magnetic stainless steel or the like, and produced through press working such as deep draw processing or the like, so that the produced cylindrical body has a stepped portion in a direction along the center axial line 1*a*. With this, the diameter of the base end portion of the cylindrical body 5 is larger than that of the top end portion of the same.

The base end portion of the cylindrical body 5 is formed with a fuel inlet opening 2 and a fuel filter 13 is fitted to the fuel inlet opening 2 to remove foreign matter mixed into fuel.

The base end portion of the cylindrical body 5 is radially outwardly expanded to form a flange portion (radially outwardly expanded portion) 5*d*, and an O-ring 11 is put in an annular recessed portion (annular groove portion) provided between the flange portion 5*d* and a base end side end portion 47*a* of a cover 47.

The top end portion of the cylindrical body 5 is provided with a valve portion 7 that includes a valve body 27*c* and a valve seat member 15. The valve seat member 15 is inserted into the top end side of the cylindrical body 5 and secured to the cylindrical body 5 by laser welding 19. The laser welding 19 is applied to the whole periphery of the outer cylindrical surface of the cylindrical body 5 from an outer circumference side. If desired, the valve seat member 15 may be secured to the cylindrical body 5 by laser welding after the valve seat member 15 is pressed into the top end side of the cylindrical body 5.

In a middle portion of the cylindrical body 5, there is arranged a drive section 9 for driving the valve body 27*c*. The drive section 9 is constituted by an electromagnetic actuator (electromagnetic drive section). More specifically, the drive section 9 is constructed by using a fixed iron core 25 that is fixed to an interior (inner circumference side) of the cylindrical body 5, a movable element (movable member) 27 that is arranged inside the cylindrical body 5 at the top end side relative to the fixed iron core 25 and movable in a direction along the center axis line 1*a*, an electromagnetic coil 29 that is mounted around the cylindrical body 5 at a position where the fixed iron core 25 and a movable iron core 27*a* provided by the movable element 27 face each other with a fine gap δ1 kept therebetween, and a yoke 33 that covers the electromagnetic coil 29 from an outer circumference side of the electromagnetic coil 29.

Within the cylindrical body 5, there is installed the movable element 27. The cylindrical body 5 faces or surrounds an outer cylindrical surface of the movable iron core 27*a* to form a housing that covers the movable iron core 27*a*.

The movable iron core 27*a*, the fixed iron core 25 and the yoke 33 constitute a closed magnetic circuit through which a magnetic flux flows when the electromagnetic coil 29 is energized. The magnetic flux is able to pass through the fine gap δ1. However, in order to reduce a leakage flux flowing in the cylindrical body 5 at the position where the fine gap δ1 is provided, a non-magnetic section or a weak magnetic section 5*c* that is weaker in magnetism than other parts of the cylindrical body 5 is provided at a position corresponding to the fine gap δ1 of the cylindrical body 5. In the following explanation, the non-magnetic section or the weak magnetic section 5*c* will be called just non-magnetic section 5*c*. The non-magnetic section 5*c* can be produced by applying a non-magnetizing treatment to the cylindrical body 5 that is magnetized. For such non-magnetizing treatment, heat treatment can be used. Or, by providing the outer cylindrical surface of the cylindrical body 5 with an annular recess at the portion corresponding to the non-magnetic section 5*c*, such non-magnetic section 5*c* can be produced.

The electromagnetic coil 29 is wound around a bobbin 31 that is made of resin and cylindrically shaped, and the bobbin is disposed around the cylindrical body 5. The electromagnetic coil 29 is electrically connected to terminals 43 provided in a connector 41. To the connector 41, there is connected an external drive circuit, so that a drive current is applied to the electromagnetic coil 29 through the terminals 43.

The fixed iron core 25 is made of a magnetic metallic material. The fixed iron core 25 is shaped cylindrical and has a through hole 25*a* that passes and extends through a central portion in a direction along the center axis line 1*a*. The fixed iron core 25 is press-fitted to a base end side of a smaller diameter portion 5*b* of the cylindrical body 5 and positioned at a middle portion of the cylindrical body 5. Since a larger diameter portion 5*a* is provided at the base end side of the smaller diameter portion 5*b*, assembling work for the fixed iron core 25 is facilitated. The fixed iron core 25 may be fixed to the cylindrical body 5 by welding, or fixed to the cylindrical body 5 by both of welding and press-fitting.

The movable element 27 is constructed by using the movable iron core 27*a*, the rod portion (connecting portion) 27*b* and the valve body 27*c*. The movable iron core 27*a* is of an annular member. The valve body 27*c* is a member contactable with the valve seat 15*b* (see FIG. 2). The valve seat 15*b* and the valve body 27*c* cooperate with each other to open and close a fuel passage. The rod portion 27*b* has a slender cylindrical shape and constitutes a connecting portion through which the movable iron core 27*a* and the valve body 27*c* are connected. The movable iron core 27*a* is connected to the valve body 27*c* to constitute a member that drives the valve body 27*c* in open/close direction by using a magnetic attraction force applied between the movable iron core and the fixed iron core 25.

In this embodiment, the rod portion 27*b* and the valve body 27*c* are constructed by different materials and the valve body 27*c* is connected to the rod portion 27*b*. The connection between the rod portion 27*b* and the valve body 27*c* is made through press-fitting or welding. If desired, the rod portion 27*b* and the valve body 27*c* may be integrally constructed by one member.

The rod portion 27*b* is shaped cylindrically and has a hole 27*ba* that extends therein in an axial direction to be exposed to the outside through an opening at the upper end of the rod portion 27*b*. The rod portion 27*b* is formed with connection openings (open portions) 27*boa* and 27*bob* each connecting the inside and outside of the rod portion. Between the outer cylindrical surface of the rod portion 27*b* and the inner cylindrical surface of the cylindrical body 5, there is defined a back pressure chamber 37. An upper end portion 27*bc* of the rod portion 27*b* is inserted into a through hole 25*a* of the fixed iron core 25, and the fuel passage 3 in the through hole 25*a* is connected to the back pressure chamber 37 through the hole 27*ba* and the connection openings 27*boa* and 27*bob*. The hole 27*ba* and the connection openings 27*boa* and 27*bob* constitute the fuel passage 3 through which the fuel passage 3 in the through hole 25*a* and the back pressure chamber 37 are connected or communicated.

The through hole 25*a* of the fixed iron core 25 is provided with a coil spring 39. One end of the coil spring 39 is in contact with a spring seat 27*ag* that is provided inside the movable iron core 27*a*. The other end of the coil spring 39 is in contact with an adjuster (adjusting element) 35 that is arranged inside the through hole 25*a* of the fixed iron core 25. The coil spring 39 is arranged to be compressed between the spring seat 27*ag* provided by the movable iron core 27*a* and a lower end (top end side end surface) of the adjuster (adjusting element) 35.

Figure 2:
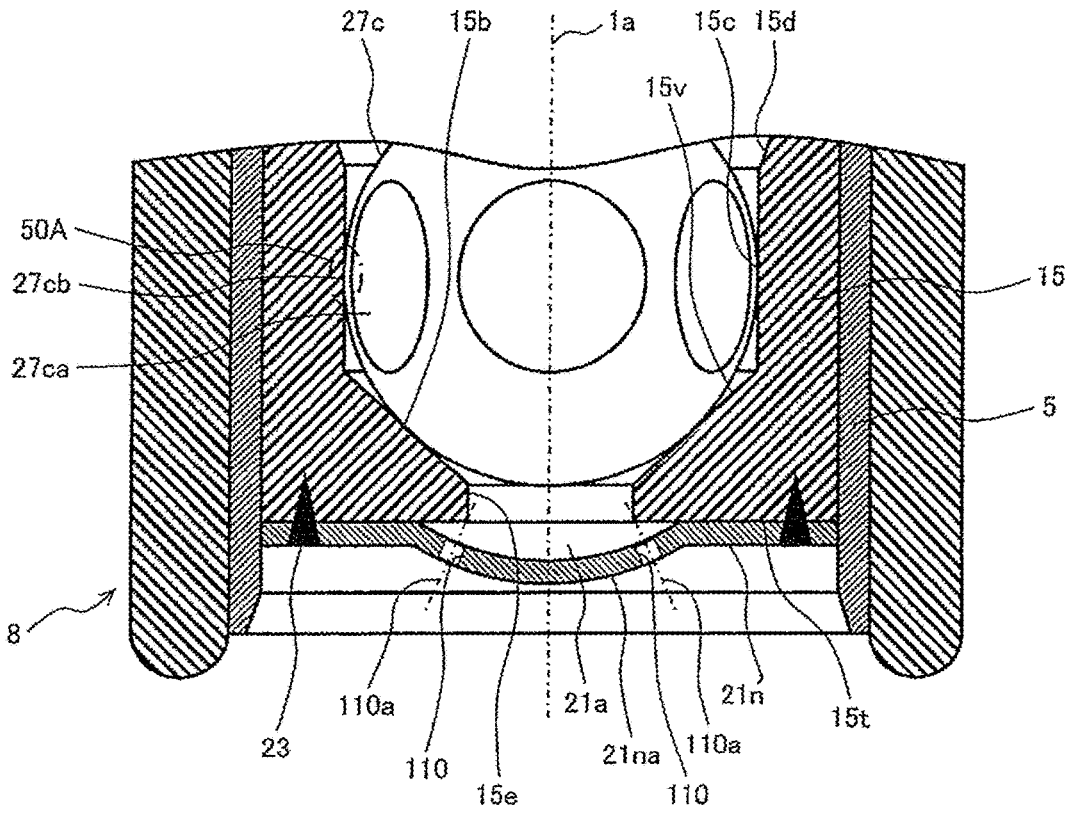
FIG. 2 is an enlarged sectional view of a portion in the vicinity of a nozzle part 8 shown in FIG. 1.
Figure 3:
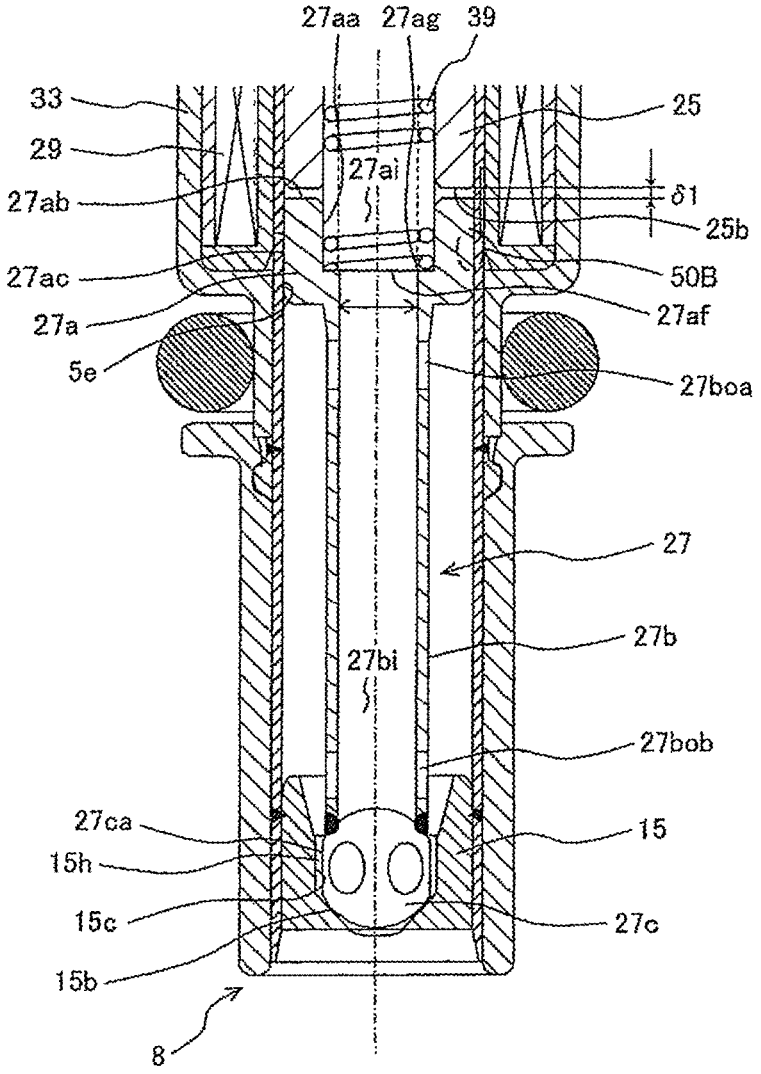
FIG. 3 is an enlarged sectional view of a portion in the vicinity of a movable element 27.

The coil spring 39 serves as a biasing member that biases the movable element 27 in a direction (valve close direction) to cause the valve body 27*c* to contact the valve seat 15*b* (see FIG. 2). By adjusting the position of the adjuster 35 in the through hole 25*a* in a direction along the center axis line 1*a*, the biasing force applied from the coil spring 39 to the movable element 27, which is a mover element having magnetic material, can be adjusted.

The adjuster 35 is formed with a fuel passage 3 that passes through a center portion thereof in a direction along the center axis line 1*a*. Fuel supplied from the fuel inlet opening 2 flows in the fuel passage 3 of the adjuster 35, then flows in the fuel passage 3 of the top end side portion of the through hole 25*a* of the fixed iron core 25, and then flows in the fuel passage 3 provided by the movable element 27.

The yoke 33 is made of a magnetic metallic material and serves both as yoke and a housing of the fuel injection valve 1. The yoke 33 is shaped like a stepped cylindrical member including a larger diameter portion 33*a* and a smaller diameter portion 33*b*. The larger diameter portion 33*a* is shaped cylindrical to cover an outer cylindrical surface of the electromagnetic coil 29 and has at the top end side thereof the smaller diameter portion 33*b* whose diameter is smaller than that of the larger diameter portion 33*a*. The smaller diameter portion 33*b* is press-fitted to or tightly disposed on the smaller diameter portion 5*b* of the cylindrical body 5. With this, the inner cylindrical surface of the smaller diameter portion 33*b* is intimately contact with the outer cylindrical surface of the cylindrical body 5. Under this condition, at least one part of the inner cylindrical surface of the smaller diameter portion 33*b* faces the outer cylindrical surface of the movable iron core 27*a* through the cylindrical body 5, and thus, the magnetic resistance of magnetic path produced at the opposed portions is reduced.

The top end side end portion of the yoke 33 is formed at its outer cylindrical surface with an annular recessed portion 33*c* that extends in a circumferential direction. At a thin wall part provided behind a bottom surface of the annular recessed portion, the yoke 33 and the cylindrical body 5 are joined to each other by laser welding all over the circumference.

Onto the top end portion of the cylindrical body 5, there is disposed a cylindrical protector 49 that has a flange part 49*a* formed thereon, and thus the top end portion of the cylindrical body 5 is protected by the protector 49. The protector 49 covers an upper part of a laser weld portion 24 of the yoke 33.

The flange part 49*a* of the protector 49, the diameter smaller portion 33*b* of the yoke 33 and a step surface defined between the larger and smaller diameter portions 33*a* and 33*b* of the yoke 33 constitute an annular groove 34 into which an O-ring 46 is received. At the time when the fuel injection valve 1 is going to be fitted to the internal combustion engine, the O-ring 46 serves as a sealing means that effects a liquid tight and airtight function against an annular space defined between an inner cylindrical surface of a valve mounting hole formed in the internal combustion engine and the outer cylindrical surface of the smaller diameter portion 33*b* of the yoke 33.

A given area of the fuel injection valve 1 from a middle portion thereof to a portion near the base end side thereof is covered with a molded resin cover 47. A top end side end portion of the resin cover 47 covers a part of the base end side of the larger diameter portion 33*a* of the yoke 33. By the resin that forms the resin cover 47, the connector 41 is integrally formed or provided.

In the following, construction of the nozzle part 8 will be described in detail with reference to FIG. 2. FIG. 2 is an enlarged sectional view of a portion in the vicinity of the nozzle part 8 shown in FIG. 1.

The valve seat member 15 is formed with a through hole 15*d*, 15*c*, 15*v* and 15*e* that extends or penetrates in a direction along the center axis line 1*a*. This through hole has at a part thereof a conical surface 15*v* whose diameter reduces as approaching toward the downstream side. The conical surface 15*v* forms thereon the valve seat 15*b*, and when the valve body 27*c* is released from and put on the valve seat 15*b*, the fuel passage is opened and closed. In the following explanation, the conical surface 15*v* forming the valve seat 15*b* may be called as a valve seat surface. The valve seat 15*b* and a portion of the valve body 27*c* that contacts the valve seat 15*b* are called as a seal portion.

An upper hole portion 15*d*, 15*c* and 15*v*, which is placed above the conical surface 15*v* in the through hole 15*d*, 15*c*, 15*v* and 15*e*, forms a valve body receiving hole for holding the valve body 27*c*. An inner cylindrical surface of the valve body receiving hole is formed with a guide surface 15*c* for guiding the valve body 27*c* to move in a direction along the center axis line 1*a*. The guide surface 15*c* is one of two guide surfaces that guide the movement of the movable element 27, and the guide surface 15*c* serves as a downstream side guide surface placed at a downstream side.

The downstream side guide surface 15*c* and a slide surface 27*cb* of the valve body 27*c* that slides on the downstream side guide surface 15*c* constitute a downstream side guide portion 50A that guides displacement or movement of the movable element 27.

At an upstream side of the guide surface 15*c*, there is provided a conical surface 15*d* whose diameter increases as approaching toward the upstream side. By the presence of the conical surface 15*d*, assembling work for the valve body 27*c* is facilitated and enlargement of sectional area of the fuel passage is assured. A lower end portion of the valve body receiving hole 15*d*, 15*c* and 15*v* is connected to a fuel introducing hole 15*e*, and a lower end surface of the fuel introducing hole 15*e* is exposed to a top end surface 15*t* of the valve seat member 15.

To the top end surface 15*t* of the valve seat member 15, there is connected a nozzle plate 21*n*. The nozzle plate 21*n* is fixed to the valve seat member 15 by laser welding 23. The laser weld portion 23 extends around an injection hole forming area to enclose fuel injection openings 110 provided within the injection hole forming area.

The nozzle plate 21*n* is constructed of a plate member (flat plate) of uniform thickness and has at its central portion a projected portion 21*na* that projects outward. The projected portion 21*na* is shaped by a curved surface (for example, spherical surface). Inside the projected portion 21*na*, there is defined a combustion chamber 21*a*. The combustion chamber 21*a* is connected to the fuel introducing hole 15*e* formed in the valve seat member 15, so that fuel is supplied to the combustion chamber 21*a* through the fuel introducing hole 15*e*.

The projected portion 21*na* is formed with the plurality of fuel injection openings 110. Each of the fuel injection openings 110 can employ any form. For example, each fuel injection opening may have at an upstream part thereof a swirling chamber for providing fuel with swirling power. A center axis line 110*a* of each fuel injection opening may be in parallel with the center axis line 1*a* of the fuel injection valve, or the center axis line 110*a* may be inclined relative to the line 1*a*. Furthermore, the projected portion 21*na* may be of a type that has no projected portion.

In the embodiment, the valve portion 7 that opens and closes the fuel injection openings 110 comprises the valve seat member 15 and the valve body 27*c*, and a fuel injection portion that decides the form of fuel spray comprises the nozzle plate 21*n*. The valve portion 7 and the fuel injection portion constitute a nozzle portion 8 that makes a fuel injection. That is, in the nozzle portion 8 of the embodiment, the nozzle plate 21*n* is connected to a top end surface 15*t* of a body side (valve seat member 15) of the nozzle portion 8.

Furthermore, in the embodiment, the valve body 27*c* is a ball valve having a spherical shape. Accordingly, a portion of the valve body 27*c*, which faces the guide face 15*c*, is formed with a plurality of circumferentially spaced cut surfaces 27*ca* by which a fuel passage 15*h* (see FIG. 3) is formed. The valve body 27*c* may be constructed of a valve body other than the ball body. For example, needle valve is usable.

A construction in the vicinity of the movable element 27 will be described in detail with reference to FIG. 3. FIG. 3 is an enlarged sectional view of a portion in the vicinity of the movable element 27.

In the embodiment, the movable iron core 27*a* and the rod portion 27*b* are integrally constructed from one member. A central portion of an upper end surface 27*ab* of the movable iron core 27*a* is formed with a recessed portion 27*aa* that is recessed downward. At a bottom of the recessed portion 27*aa*, there is formed a valve seat 27*ag* by which one end of a coil spring 39 is supported. Furthermore, at the bottom of the recessed portion 27*aa*, there is provided an open portion 27*af* that communicates with the interior of the rod portion 27*b*. The open portion 27*af* constitutes a fuel passage that allows fuel, which has come to a space 27*ai* in the recessed portion 27*aa* from the through hole 25*a* of the fixed iron core 25, to flow to a space 27*bi* in the rod portion 27*b*.

Although, in the embodiment, the rod portion 27*b* and the movable iron core 27*a* are integrally constructed from one member, they may be constructed from separate members and thereafter they may be integrally connected to each other.

The upper end surface 27*ab* of the movable iron core 27*a* is a surface that faces a lower end surface 25*b* of the fixed iron core 25. The upper end surface 27*ab* and the lower end surface 25*b* respectively constitute magnetic attracting surfaces against which magnetic attracting force is applied respectively. An outer cylindrical surface 27*ac* of the movable iron core 27*a* is constructed to slide on an inner cylindrical surface 5*e* of the cylindrical body 5. The inner cylindrical surface 5*e* constitutes an upstream side guide surface, and the outer cylindrical surface 27*ac* slides on the upstream side guide surface 5*e*. The upstream side guide surface 5*e* and the outer cylindrical surface 27*ac* of the movable iron core 27*a* constitute an upstream side guide portion 50B that guides displacement or movement of the movable element 27.

The movable element 27 is guided by two points that are the upstream side guide portion 50B and the afore-mentioned downstream side guide portion 50A, and moved forward and backward along the center axis line 1*a*.

As is mentioned hereinabove, the rod portion 27*b* is formed with the communication holes 27*boa* and 27*bob* through which the inside and outside of the rod portion 27*b* are communicated. The communication hole 27*boa* is provided at an upper part of the rod portion 27*b* and arranged near the movable iron core 27*a*. The communication hole 27*bob* is provided at a lower part of the rod portion 27*b* and arranged near the valve body (seal portion) 27*c*. In the embodiment, the communication holes 27*boa* and 27*bob* are provided to suppress generation of a dead fuel flow region (stagnation) that would appear near the rod portion 27*b* of the movable element 27.

Figure 9:
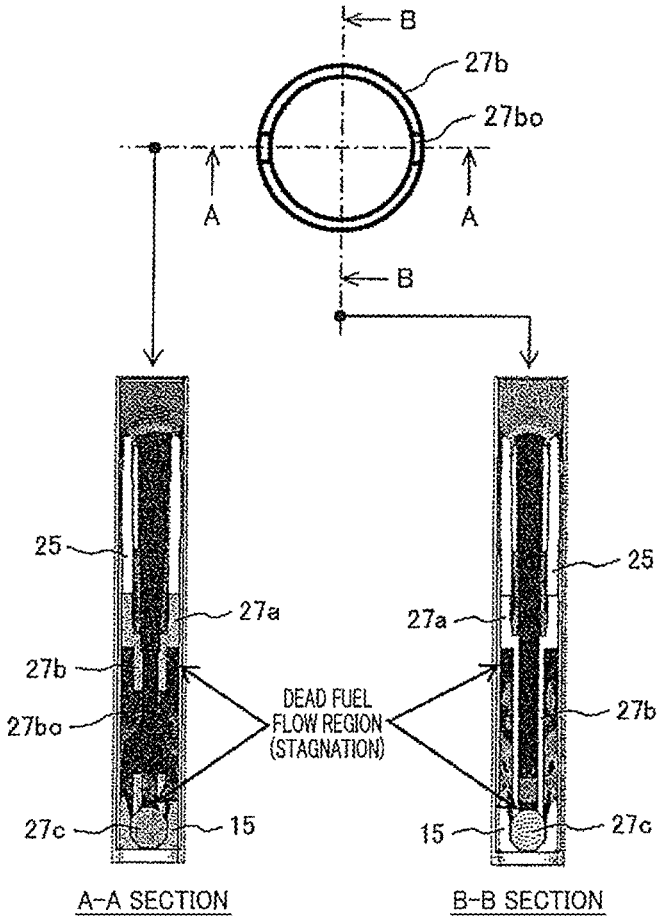
FIG. 9 is an analysis diagram showing a performance of an comparative example with respect to the fuel flow speed distribution appearing near the rod portion 27*b*.

In the following, a fuel flow appearing near the rod portion 27*b* will be described with reference to a comparative example of FIG. 9. FIG. 9 is an analysis diagram showing a performance of the comparative example with respect to the fuel flow speed distribution appearing near the rod portion 27*b*. In FIG. 9, there are shown a sectional view taken along the line A-A that passes through the communication holes 27*bo* and another sectional view taken along the line B-B that is perpendicular to the line A-A and does not pass through the communication holes 27*bo*. It is to be noted that the communication holes 27*bo* are respectively provided at two positions of the rod portion 27*b* that are spaced from each other by 180 degrees in a circumferential direction.

In the comparative example, the rod portion 27*b* is formed at a middle part thereof with an axially extending communication hole (open portion) 27*bo*. However, in this case, the outer cylindrical surface side of the rod portion 27*b* tends to generate a dead fuel flow region (upper dead fuel flow region) at an area between the lower end portion of the movable iron core 27*a* and an upper end portion of the communication hole 27*bo*. The dead fuel flow region extends to an upper area of the communication hole 27*bo*. Furthermore, in the inner cylindrical surface side (inside) of the rod portion 27*b*, the lower end part of the rod portion 27*b* to which the valve body 27*c* constituting the seal portion is connected tends to generate a dead fuel flow region (lower dead fuel flow region).

Such dead fuel flow regions are caused by a stagnation of fuel flow produced when the fuel flow speed becomes very slow. In order to wash foreign things away from the dead fuel flow region with the slow speed fuel flow, it takes time. Accordingly, it is desirable to suppress generation of the dead fuel flow region or minimize area of the dead fuel flow region as small as possible.

Accordingly, in the embodiment, in order to suppress generation of the upper dead fuel flow region and lower dead fuel flow region or minimize the area of the upper dead fuel flow region and lower dead fuel flow region, communication holes are grouped into two, one being arranged at an upper end side of the rod portion 27*b* and the other being arranged at a lower end side of the rod portion 27*b*. That is, the communication holes are divided into at least two and respectively arranged at axially spaced two portions of the rod portion 27*b*. One (the upstream-side communication hole 27*boa*) of the two portions is positioned in the vicinity of the lower end portion of the movable iron core 27*a* (the upper end portion of the rod portion 27*b*), and the other one (the downstream-side communication hole 27*bob*) of the two portions is positioned in the vicinity of the valve body 27*c* (the lower end portion of the rod portion 27*b*). For example, the upstream-side communication hole 27*boa* is so arranged that an upper end portion of the hole 27*boa* is not placed apart from the lower end portion of the movable iron core 27*a* by a distance longer than an inner diameter of the rod portion 27*b*. Furthermore, the downstream-side communication hole 27*bob* is so arranged that the lower end portion of the hole 27*bob* is not placed apart from the lower end of the rod portion 27*b* by a distance longer than the inner diameter of the rod portion 27*b*.

The downstream side guide portion 50A is formed with the fuel passage 15*h* that extends in the direction of the center axis line 1*a* to communicate the upstream side of the guide portion with the downstream side of the same. The fuel passage 15*h* is defined between the cut surfaces 27*ca* of the valve body 27*c* and the inner cylindrical surface (downstream side guide surface) 15*c* of the valve body receiving hole formed in the valve seat member 15. The fuel passage 15*h* is arranged in the same angular position as the downstream-side communication hole 27*bob* with respect to a circumferential direction of the movable element 27 or the rod portion 27*b*. A center axis line of the downstream-side communication hole 27*bob* and a center axis line of the cut surfaces 27*c* are parallel with each other and present in a single virtual plane. The center axis line 1*a* is also present in the virtual plane.

With the above-mentioned arrangement, fuel led into the back pressure chamber 37 from the downstream-side communication hole 27*bob* can smoothly flow into the fuel passage 15*h* formed in the downstream side guide portion 50A. Thus, the fuel flow speed can be increased at the outlet portion of the downstream-side communication hole 27*bob*, and thus, generation of dead fuel flow region can be suppressed.

Furthermore, a sectional area (opening area) S1 of the upstream-side communication hole 27*boa* and a sectional area (opening area) S2 of the downstream-side communication hole 27*bob* are so set as to increase the flow speed of fuel that flows in the vicinity of the rod portion 27*b*. In the following, the results of analyzing the fuel flow in the vicinity of the rod portion 27*b* will be explained with reference to FIGS. 4 to 7.

Figure 4:
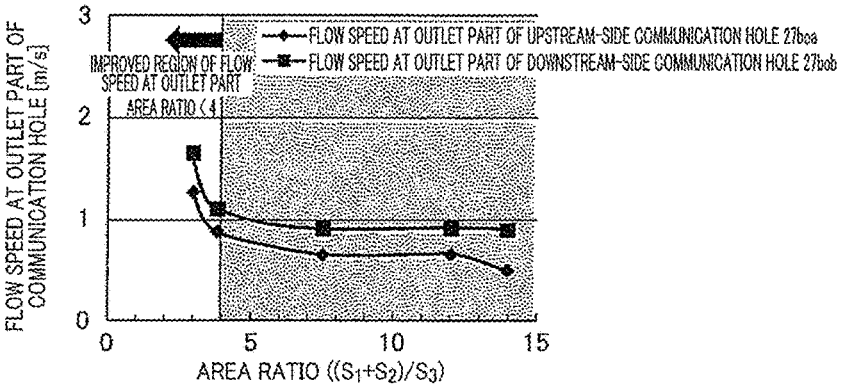
FIG. 4 is an analysis diagram showing the flow speed variation that appears at respective outlet portions of communication holes 27*boa* and 27*bob* when the ratio ((S1+S2)/S3) between the sum (S1+S2) of the sectional area S1 of an upstream-side communication hole 27*boa* and the sectional area S2 of a downstream-side communication hole 27*bob* and the sectional area S3 of an open portion 27*af* through which a movable iron core 27*a* is communicated with a rod portion 27*b* is varied.

FIG. 4 is an analysis diagram showing the flow variation that appeared at respective outlet portions of the communication holes 27*boa* and 27*bob* when the ratio ((S1+S2)/S3) between the sum (S1+S2) of the sectional area S1 of the upstream-side communication hole 27*boa* and the sectional area S2 of the downstream-side communication hole 27*bob* and the sectional area S3 of the open portion 27*af* through which the movable iron core 27*a* is communicated with the rod portion 27*b* is varied.

The sectional area S3 is a sectional area of the open portion 27*af* through which the movable iron core 27*a* is fluidly communicated with the rod portion 27*b*. The sectional area S3 is a sectional area of a fuel passage provided at an inlet part of the fuel passage 3 formed in the rod portion 27*b*. In case where the fuel passage provided in the inner cylindrical portion 27*bs* is divided into a plurality of fuel passages, the sectional area S3 is a total sum of the sectional areas of the plurality of fuel passages. The sectional area S3 is a sectional area of a fuel passage that supplies the fuel which flows from the upstream-side communication hole 27*boa* and the downstream-side communication hole 27*bob*.

In the embodiment, the upstream-side communication hole 27*boa* comprises two openings that are spaced from each other by 180 degrees in a circumferential direction of the rod portion 27*b*. The sectional area S1 of the upstream-side communication hole 27*boa* is the sum of the sectional areas of the two openings of the hole 27*boa*. The downstream-side communication hole 27*bob* comprises two openings that are spaced from each other by 180 degrees in the circumferential direction of the rod portion 27*b*. The sectional area S2 of the downstream-side communication hole 27*bob* is the sum of the sectional areas of the two openings of the hole 27*bob*.

As is seen from FIG. 4, in a range where the area ratio ((S1+S2)/S3) is smaller than 4.0, the fuel flow speed at the outlet portions of the communication holes 27*boa* and 27*bob* increases as the sectional ratio becomes small. When the area ratio ((S1+S2)/S3) is equal to or larger than 4.0, the fuel flow speed at the outlet portions of the communication holes 27*boa* and 27*bob* becomes generally constant and shows a value smaller than the value appearing when the sectional ratio ((S1+S2)/S3) is smaller than 4.0.

Figure 5:
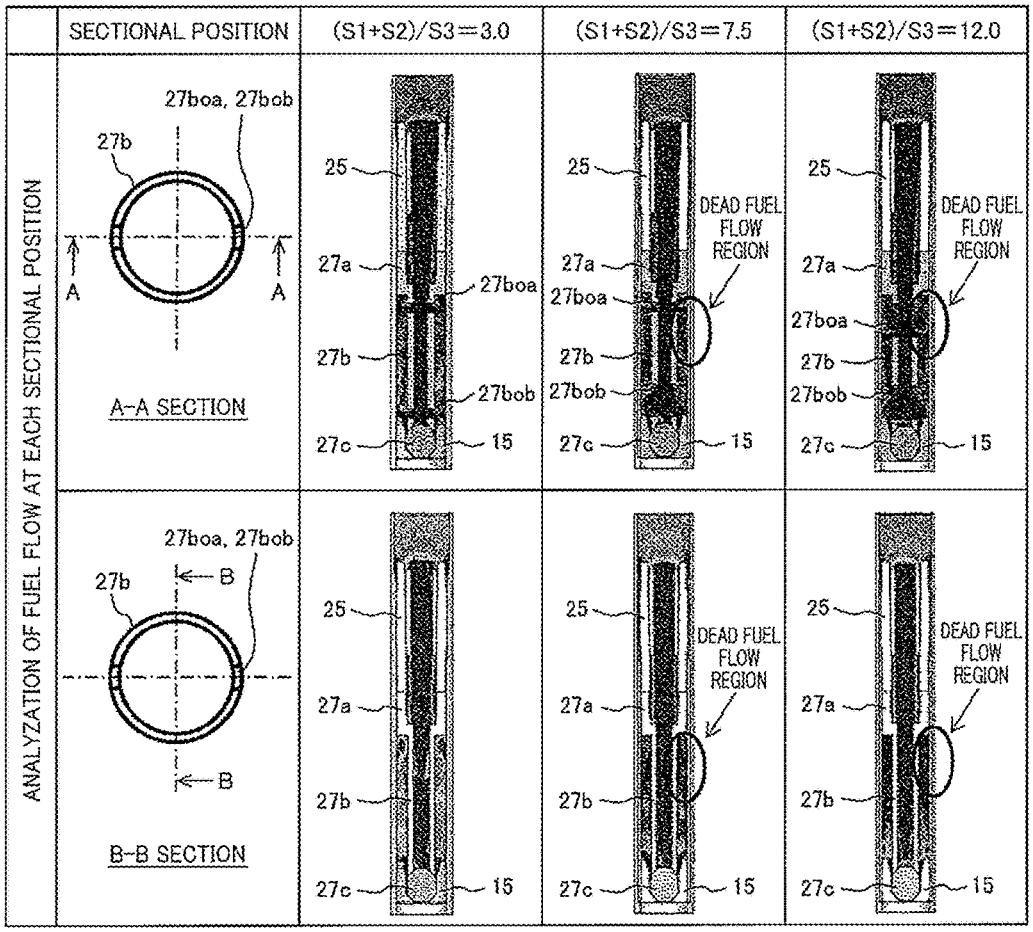
FIG. 5 is an analysis diagram showing a flow speed distribution that appears when the area ratio ((S1+S2)/S3) is 3.0, 7.5 or 12.0.

FIG. 5 is an analysis diagram showing a flow speed distribution that appeared when the area ratio ((S1+S2)/S3) is 3.0, 7.5 or 12.0. Also in FIG. 5, like in FIG. 9, there is shown the flow speed distribution with respect to a sectional view taken along the line A-A and another sectional view taken along the line B-B.

When the area ratio ((S1+S2)/S3) is 3.0, the lower side of the lower end face of the movable iron core 27*a* has no portion where the fuel flow speed is lowered to such a degree as to generate the dead fuel flow region in both the area of the sectional view of the line A-A and the area of the sectional view of the line B-B. As is mentioned in the description of FIG. 4, we consider that the fuel flow speed is increased at the outlet portions of the communication holes 27*boa* and 27*bob*.

While, when the area ratio ((S1+S2)/S3) is 7.5 or 12.0, the lower side of the lower end face of the movable iron core 27*a* has therearound a portion where the fuel flow speed is reduced to such a degree as to generate the dead fuel flow region in both the area of the sectional view of the line A-A and the area of the sectional view of the line B-B. We consider that generation of such dead fuel flow region is caused by a lowered fuel flow speed at the outlet portions of the communication holes 27*boa* and 27*bob*.

When the area ratio ((S1+S2)/S3) is 7.5, the opening area of the upstream-side communication hole 27*boa* is the same as that provided when the area ratio ((S1+S2)/S3) is 3.0, and the opening area of the downstream-side communication hole 27*bob* is increased. In this case, the dead fuel flow region appears at a downstream side of the upstream-side communication hole 27*boa*.

While, when the area ratio ((S1+S2)/S3) is 12.0, the opening area of the downstream-side communication hole 27*bob* is the same as that provided when the area ratio ((S1+S2)/S3) is 7.5, and the opening area of the upstream-side communication hole 27*boa* is increased. In this case, the dead fuel flow region appears at a side area of the upstream-side communication hole 27*boa*. This may be because the fuel flow has a larger speed component in the axial direction of the rod portion 27*b*, the fuel flow is discharged from a lower portion of the enlarged upstream side-communication hole 27*boa* and the discharging position of the fuel flow from the upstream-side communication hole 27*boa* is shifted toward the lower end side of the rod portion 27*b*. Furthermore, it is considered that since the opening area of the downstream-side communication hole 27*bob* is increased, the fuel flow in the rod portion 27*b* toward the lower end portion thereof is easily made.

As is mentioned hereinabove, by setting the area ratio ((S1+S2)/S3) to a range smaller than 4.0, it is possible to increase the fuel speed at the outlet portions of the communication holes 27*boa* and 27*bob*. With this, it is possible to suppress generation of the dead fuel flow region in the vicinity of the rod portion 27*b*.

It is to be noted that the lower limit value of the area ratio ((S1+S2)/S3) is affected by a sectional area of a fuel passage that is provided at a downstream side of the upstream-side and downstream-side communication holes 27*boa* and 27*bob*. In general, the fuel injection amount is decided by both the area of an annular space defined between the valve body 27*c* and the valve seat 15*b* and the total sectional area of the fuel injection hole. The area of the annular space defined between the valve body 27*c* and the valve seat 16*b* or the total sectional area of the fuel injection hole is the smallest in the fuel passage defined by the fuel injection valve. Thus, it is necessary to make the opening area (S1+S2) of the communication holes 27*boa* and 27*bob* larger than the area of the annular space between the valve body 27*c* and the valve seat 15*b* and the total sectional area of the fuel injection hole. Thus, the opening area (S1+S2) of the communication holes 27*boa* and 27*bob* is set larger than the area of the annular space defined between the valve body 27*c* and the valve seat 15*b* and the total sectional area of the fuel injection hole. By using the opening area (S1+S2) thus set, the lower limit value of the area ratio ((S1+S2)/S3) is decided.

Both the area (S1+S2) and the area S3 of the fuel passage are larger than the area of the annular space defined between the valve body 27*c* and the valve seat 15*b* and the total sectional area of the fuel injection hole. Accordingly, the lower limit valve of the area ratio ((S1+S2)/S3) has a chance to be smaller than 1 (one). However, in order to smooth the flow out of fuel from the communication holes 27*boa* and 27*bob* by removing a pressure loss appearing at the rod portion 27*b*, it is preferable to set the area ratio ((S1+S2)/S3) to a value that is 1 (one) or larger than 1 (one).

Figure 6:
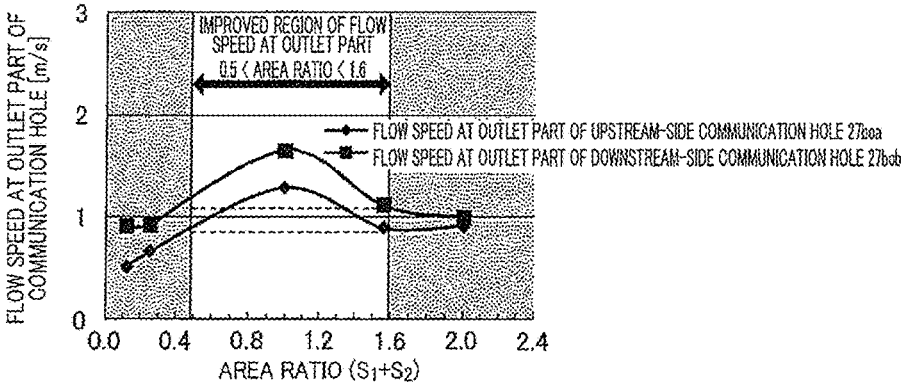
FIG. 6 is an analysis diagram showing the flow speed variation that appears at the respective outlet portions of the communication holes 27*boa* and 27*bob* when the ratio (S1/S2) between the sectional area S1 of the upstream-side communication hole 27*boa* and the sectional area S2 of the downstream-side communication hole 27*bob* is varied.

FIG. 6 is an analysis diagram showing the flow speed variation that appears at the respect outlet portions of the communication holes 27*boa* and 27*bob* when the ratio (S1/S2) between the sectional area S1 of the upstream-side communication hole 27*boa* and the sectional area S2 of the downstream-side communication hole 27*bob* is varied.

When the area ratio (S1/S2) between the sectional area S1 of the upstream-side communication hole 27*boa* and the sectional area S2 of the downstream-side communication hole 27*bob* is 1.0, the fuel flow at the respective outlet portions of the communication holes 27*boa* and 27*bob* shows the highest speed. Then, by using a speed value (0.9 m/s) in FIG. 4, which appears at the outlet portion of the upstream side-communication hole 27*boa* when the area ratio ((S1+S2)/S3) is 4.0, as a reference, an allowable range of the area ratio (S1/S2) is set. That is, by using the upstream-side communication hole 27*boa* where the fuel flow speed is lower than that of the downstream-side communication hole 27*bob* as a reference, a range where the fuel flow speed at the outlet portion of the upstream-side communication hole 27*boa* is higher than 0.9 m/s is set to the allowable range.

In the embodiment, the area ratio (S1/S2) is set to a range or value that larger than 0.5 and smaller than 1.6. With this setting, it is possible to set both the sectional area S1 of the upstream-side communication hole 27*boa* and the sectional area S2 of the downstream-side communication hole 27*bob* in such a manner that the fuel flow speed at the respective outlet portions of the communication holes 27*boa* and 27*bob* shows a value near its maximum value and is set in a suitable range where generation of the dead fuel flow region is suppressed.

Figure 7:
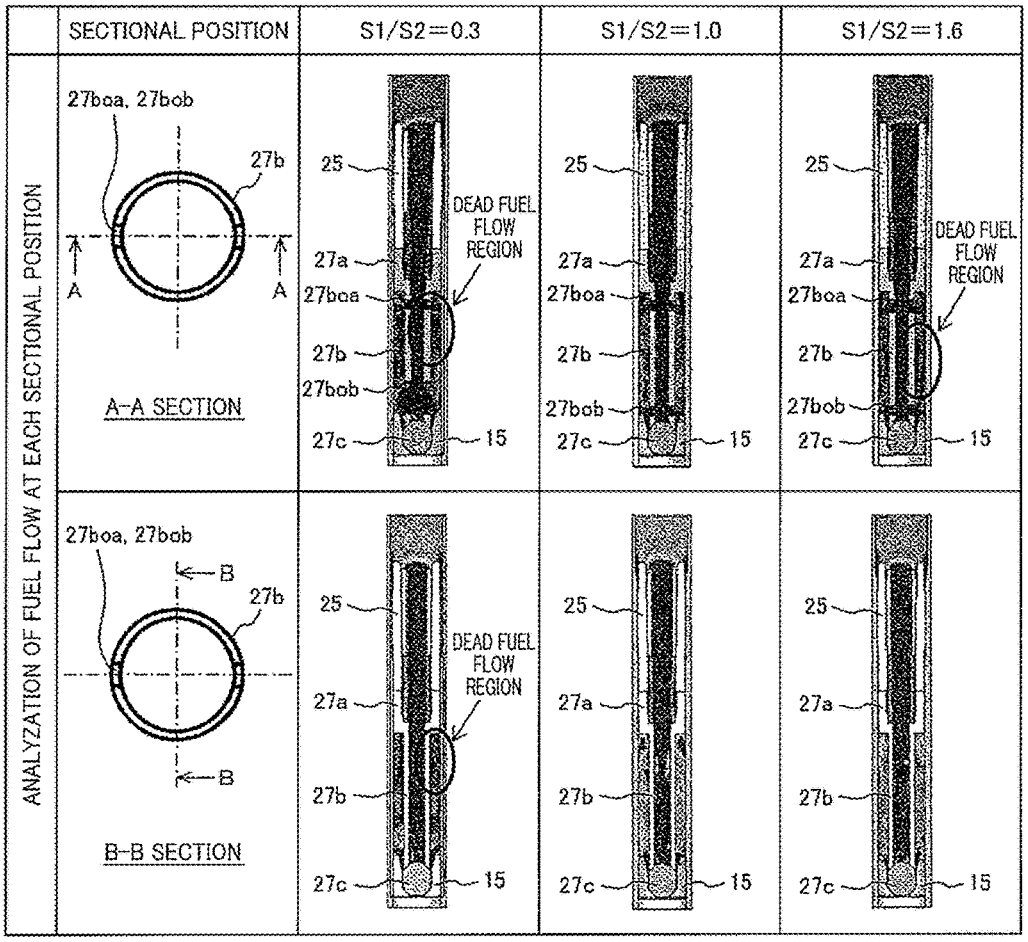
FIG. 7 is an analysis diagram showing flow speed distribution that appears when the area ratio (S1/S2) is 0.3, 1.0 or 1.6.

FIG. 7 is an analysis diagram showing flow speed distribution that appears when the area ratio (S1/S2) is 0.3. 1.0 or 1.6. Also in FIG. 7, like in FIG. 9, there is shown the flow speed distribution with respect to a sectional view taken along the line A-A and another sectional view taken along the line B-B.

When the area ratio (S1/S2) is 1.0, the lower side of the lower end face of the movable iron core 27*a* has no portion where the fuel flow speed is lowered to such a degree as to generate the dead fuel flow region in both the area of the sectional view of the line A-A and the area of the sectional view of the line B-B.

While, when the area ratio (S1/S2) is 0.3, the lower side of the lower end face of the movable iron core 27*a* has therearound a portion where the fuel flow speed is reduced to such a degree as to generate the dead fuel flow region in both the area of the sectional view of the line A-A and the area of the sectional view of the line B-B. While, when the area ratio (S1/S2) is 1.6, the lower side of the lower end face of the movable iron core 27*a* has a small portion where the fuel flow speed is reduced to generate the dead fuel flow region. We consider that generation of the dead fuel flow region in the case where the area ratio (S1/S2) is 0.3 or 1.6 is caused by the fuel flow whose speed is reduced at the outlet portions of the communication holes 27*boa* and 27*bob*.

In the embodiment, the area ratio ((S1+S2)/S3) is set to a range smaller than 4.0 and the area ratio (S1/S2) is set to a range larger than 0.5 and smaller than 1.6, so that the fuel flow speed at the outlet portions of the communication holes 27*boa* and 27*bob* can be increased. Thus, generation of dead fuel flow region near the rod portion 27*b* can be suppressed.

It is to be noted that the number of the upstream-side communication hole (holes) 27*boa* and the number of the downstream-side communication hole (holes) 27*bob* are not limited to two. That is, one or three and more are usable. However, when only one hole is provided in place of the two holes as each of the communication holes 27*boa* and 27*bob*, a dead fuel flow region tends to be generated at a position that is spaced from the hole by 180 degrees in a circumferential direction. Accordingly, if possible, two or more communication holes 27*boa* and 27*bob* that are equally spaced from one another in a circumferential direction should be provided.

Figure 8:
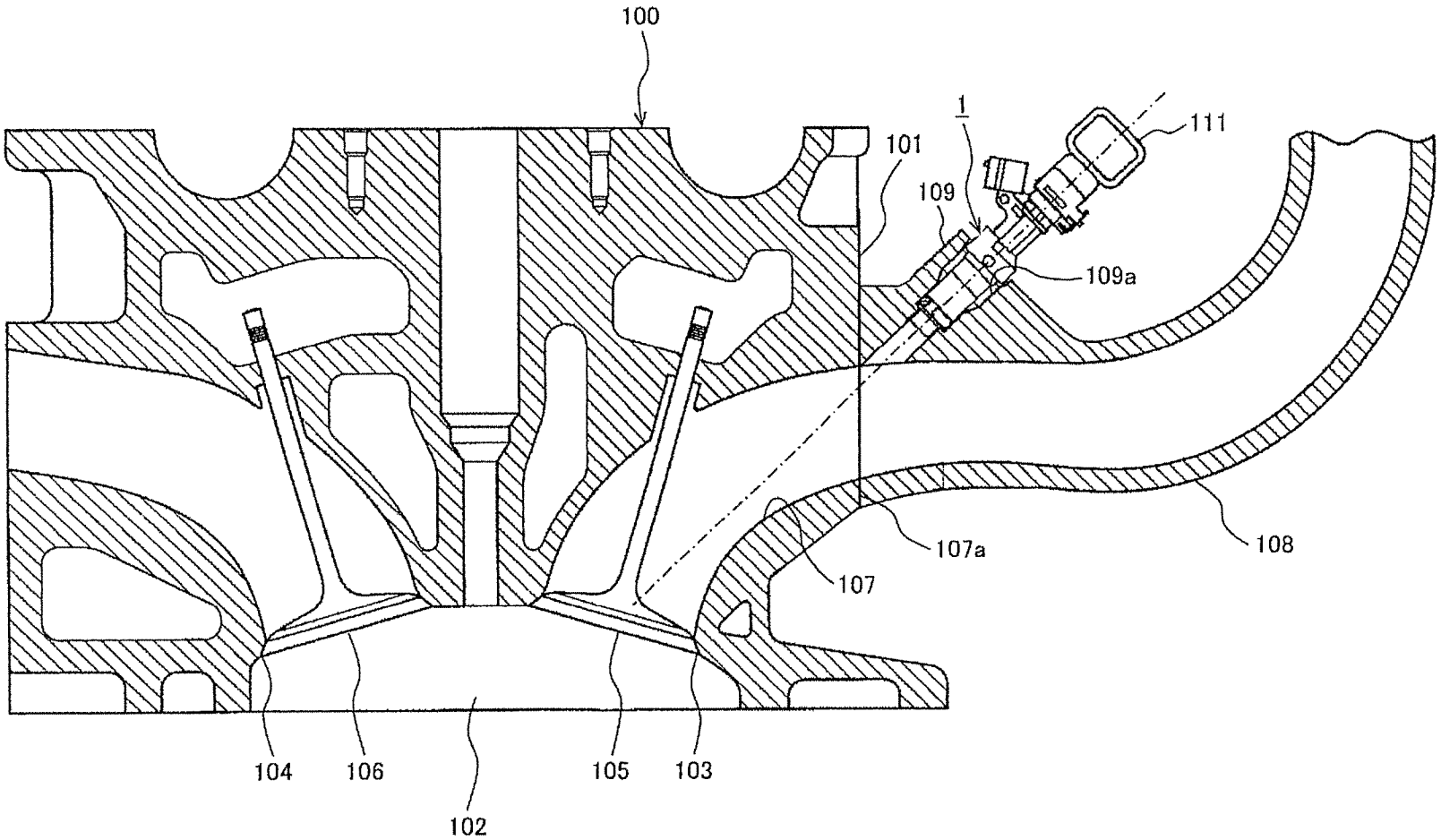
FIG. 8 is a sectional view of an internal combustion engine that has a fuel injection valve 1 mounted thereon.

In the following, an internal combustion engine to which the fuel injection valve of the present invention is practically mounted will be explained with reference to FIG. 8. FIG. 8 is a sectional view of the internal combustion engine to which the fuel injection valve 1 is practically mounted.

An engine block 101 of the internal combustion engine 100 is formed with cylinders 102. Each cylinder 102 is formed at a head portion thereof with an intake port 103 and an exhaust port 104. The intake port 103 is equipped with an intake valve 105 that opens and close the intake port 103, and the exhaust port 104 is equipped with an exhaust valve 106 that opens and closes the exhaust port 104. To an inlet side end portion 107*a* of an intake passage 107 that is formed in the engine block 101 and communicated with the intake port 103, there is fixed an intake pipe 108.

To a fuel supply opening 2 (see FIG. 1) of the fuel injection valve 1, there is connected a fuel line 111.

The intake pipe 108 is formed with a mounting portion 109 to which the fuel injection valve 1 is mounted, and the mounting portion 109 is formed with an insertion hole 109*a* into which the fuel injection valve 1 is inserted. The insertion hole 109*a* extends to an inner wall surface (intake passage), so that fuel injected from the fuel injection valve 1 inserted in the insertion hole 109*a* is injected into the intake passage. If the internal combustion engine is of a two directional spray type, the engine block 101 is formed with two intake ports 103 and fuel injections from respective fuel injection valves are directed toward the intake ports 103 (intake valves 105).

As is described hereinabove, by suitably arranging the communication holes 27*boa* and 27*bob* and making the opening area of the communication holes 27*boa* and 27*bob* to a suitable size, the flow speed of fuel that flows out from the interior of the rod portion 27*b* to the outside of the same through the communication holes 27*boa* and 27*bob* can be increased, and thus, generation of dead fuel flow region in the vicinity of the rod portion 27*b* can be suppressed. Thus, even if a foreign thing is mixed into fuel in the fuel flow passage 3, the foreign thing can be speedily removed from fuel flow passage 3, and the time for running-in operation can be shortened.

The present invention is not limited to the above-mentioned embodiment. Deletion of part of the construction and addition of part to the construction are possible in the invention.

The invention claimed is:

1. A fuel injection valve including a valve seat and a valve body that cooperate with each other to open and close a fuel passage, a movable element that has the valve body provided at one end thereof and has a fuel passage formed therein, a valve seat member having the valve seat formed thereon, an upstream-side communication hole that is located upstream of a flow of fuel and connects an inside and an outside of the movable element, and a downstream-side communication hole that is located downstream of the flow of fuel and connects the inside and outside of the movable element, in which a guide section for the valve body, where the valve seat member and the valve body are in sliding contact with each other, is provided downstream of the downstream-side communication hole, wherein:

a fuel passage configured to connect, in a center axis direction, an upstream side and a downstream side of the guide section is provided at a same angular position in a circumferential direction of the movable element as the downstream-side communication hole;

an area ratio ((S1+S2)/S3), wherein S1 is a sectional area of the upstream-side communication hole, S2 is a sectional area of the downstream-side communication hole and S3 is a sectional area of a fuel passage provided in the fuel passage of the movable element at a position upstream of the upstream-side communication hole, is smaller than 4.0; and the downstream-side communication hole is positioned in the vicinity of the valve body;

an area ratio (S1/S2) between the sectional area S1 and the sectional area S2 is larger than 0.5 and smaller than 1.6;

the movable element comprises a movable iron core and a rod portion;

the upstream-side communication hole is arranged at a position where an upper end of the upstream-side communication hole is not spaced apart from a lower end of the movable iron core by a distance equal to or larger than an inner diameter of the rod portion; and the downstream-side communication hole is arranged at a position where a lower end of the downstream-side communication hole is not spaced apart from the valve body by a distance equal to or larger than the inner diameter of the rod portion.

2. A fuel injection valve as claimed in claim 1, wherein the area ratio ((S1+S2)/S3) is larger than 1.0.

3. A fuel injection valve as claimed in claim 2, wherein:

the upstream-side communication hole includes a plurality of upstream-side open holes that are provided by the movable element in the circumferential direction, and the sectional area S1 is the sum of sectional areas of the plurality of the upstream-side open holes; and the downstream-side communication hole includes a plurality of downstream-side open holes that are provided by the movable element in the circumferential direction, and the sectional area S2 is the sum of sectional areas of the plurality of the downstream-side open holes.

4. The fuel injection valve as claimed in claim 1, wherein the downstream-side communication hole is closer to the valve body than is the upstream-side communication hole.

5. The fuel injection valve as claimed in claim 1, wherein the downstream-side communication hole is positioned between the valve body and the rod portion such that at least part of the downstream-side communication hole is positioned so as to overlap with part of the valve seat member in the center axis direction.

6. A fuel injection valve including a valve seat and a valve body that cooperate with each other to open and close a fuel passage, a mover that has the valve body provided at one end thereof and has a fuel passage formed therein, a valve seat member having the valve seat formed thereon, an upstream-side communication hole upstream of a fuel flow and configured to connect an interior and an exterior of the mover, and a downstream-side communication hole downstream of the flow of fuel and configured to connect the interior and the exterior of the mover, wherein a guide positioned where the valve seat member and the valve body are in sliding contact with each other is configured to guide movement of the valve body and is located downstream of the downstream-side communication hole, wherein:

a fuel passage configured to connect, in a center axis direction, an upstream side and a downstream side of the guide is provided at a same angular position in a circumferential direction of the mover as the downstream-side communication hole;

an area ratio ((S1+S2)/S3), wherein S1 is a sectional area of the upstream-side communication hole, S2 is a sectional area of the downstream-side communication hole and S3 is a sectional area of a fuel passage provided in the fuel passage of the mover at a position upstream of the upstream-side communication hole, is smaller than 4.0; and the downstream-side communication hole is positioned in the vicinity of the valve body;

an area ratio (S1/S2) between the sectional area S1 and the sectional area S2 is larger than 0.5 and smaller than 1.6;

the mover comprises a movable iron core and a rod portion;

the upstream-side communication hole is arranged at a position where an upper end of the upstream-side communication hole is not spaced apart from a lower end of the movable iron core by a distance equal to or larger than an inner diameter of the rod portion; and the downstream-side communication hole is arranged at a position where a lower end of the downstream-side communication hole is not spaced apart from the valve body by a distance equal to or larger than the inner diameter of the rod portion.

7. The fuel injection valve as claimed in claim 6, wherein the downstream-side communication hole is closer to the valve body than is the upstream-side communication hole.

8. The fuel injection valve as claimed in claim 6, wherein:

the mover comprises a movable iron core and a rod portion; and the downstream-side communication hole is positioned between the valve body and the rod portion such that at least part of the downstream-side communication hole is positioned so as to overlap with part of the valve seat member in the center axis direction.

* * * * *